US005273267A

United States Patent [19]

Neugebauer

[11] Patent Number: 5,273,267

[45] Date of Patent: Dec. 28, 1993

[54] COPYING MACHINE COMPRISING A DEFLECTING DEVICE

[75] Inventor: Alfred Neugebauer, Stuttgart, Fed. Rep. of Germany

[73] Assignee: Develop Dr. Eisbein GmbH & Co., Gerlingen, Fed. Rep. of Germany

[21] Appl. No.: 792,366

[22] Filed: Nov. 15, 1991

[30] Foreign Application Priority Data

Nov. 16, 1990 [DE] Fed. Rep. of Germany ..... 4036543

[51] Int. Cl.[5] ..... B65H 5/00

[52] U.S. Cl. ..... 271/10; 271/114; 271/121; 271/225

[58] Field of Search ..... 271/10, 114, 117, 121, 271/124, 126, 225

[56] References Cited

U.S. PATENT DOCUMENTS

| | | | |
|---|---|---|---|
| 4,605,217 | 8/1986 | Goi | 271/124 |
| 4,674,737 | 6/1987 | Murayoshi | 271/124 |

FOREIGN PATENT DOCUMENTS

| | | | |
|---|---|---|---|
| 0374826 | 6/1990 | European Pat. Off. | 271/121 |
| 3136206 | 3/1983 | Fed. Rep. of Germany . | |
| 0145946 | 11/1980 | Japan | 271/124 |
| 646508 | 5/1982 | Japan . | |
| 0051528 | 3/1987 | Japan | 271/121 |
| 0051230 | 3/1988 | Japan | 271/126 |
| 0212638 | 9/1988 | Japan | 271/121 |
| 2029377 | 3/1980 | United Kingdom | 271/124 |

*Primary Examiner*—H. Grant Skaggs
*Assistant Examiner*—Carol Lynn Druzbick
*Attorney, Agent, or Firm*—Evenson, McKeown, Edwards & Lenahan

[57] ABSTRACT

A copying machine including a paper sheet deflecting device is disclosed. For compact copying machines an excessively curved sheet deflection is achieved for a space-saving construction. In order to reliably and independently of the type of sheets ensure a deflection with a relatively pronounced curvature, the deflecting device of the new copying machine is constructed as a guiding element which partially surrounds a withdrawal roller and which, while leaving an introducing gap, rests with a predetermined contact force against the circumference of the withdrawal roller. The resulting active contact pressure force on the withdrawal roller for the sheet to be drawn in permits a secure paper transport with a simultaneous deflection with a small radius of curvature.

18 Claims, 1 Drawing Sheet

COPYING MACHINE COMPRISING A DEFLECTING DEVICE

BACKGROUND AND SUMMARY OF THE INVENTION

The invention relates to a copying machine comprising a deflecting device which causes a deflection of an arriving sheet by approximately 180° and which is arranged directly behind a withdrawal roller assigned to a fed stack of sheets.

In the case of known arrangements disclosed, for example, in the Japanese Patent Document JP-PS 64-6508 and the German Patent Document DE-OS 31 36 206, guide ducts, which are bent in a U-shape and through which the copying paper is moved, are used as deflecting devices. For this known type of deflection, comparatively large radii of curvature are required since otherwise the front edge of a sheet can no longer easily slide in the feeding duct which would result in a buckling of the sheet and therefore in a jamming of the paper. This difficulty with radii of curvature of the guide ducts which are too small would occur mainly in the case of heavy types of paper and in the case of foils.

It is an object of the invention to equip a copying machine at low expenditures with a space-saving deflecting device which permits a reliable deflecting of a sheet without disturbances and with a comparatively small radius of curvature.

For a copying machine of the initially mentioned type, this object is achieved in that the deflecting device is constructed as a guiding element which partially surrounds the withdrawal roller and which rests with a predetermined contact force on the circumference of the withdrawal roller.

In the case of this construction, a withdrawn sheet is not only passively deflected by walls of the introducing gap but, by means of a pressing against the withdrawal roller, is actively drawn by it around the deflection. This ensures a secure and reliable transport of a sheet, specifically also when a deflection is desirable within a small area, for reasons of a saving of space, thus with a considerable curvature. The arrangement according to the invention permits a radius of curvature of less than 20.5 mm for the deflection for example; and thus is a very flat construction.

In a further development of the invention, a leaf spring which is prestressed in a holding device resting against the withdrawal roller circumference and held in the circumferential direction, or a teflon strip is used as the guiding element. The slight sliding friction coefficient of this material facilitates the paper transport. At the same time, the use of the leaf spring or of the teflon strip as the elastic element combines favorable elasticity properties with low manufacturing expenditures.

In a further development of the invention, devices are provided for adjusting the contact force of the guiding element. As a result, the deflecting device of the copying machine can be adapted with minimal effort to the paper types or foil types to be drawn in.

In a further development of the invention, the copying machine comprises a sensor inside the transport area arranged behind the withdrawal roller as well as a coupling coupled with the sensor and arranged on a shaft of the withdrawal roller. By means of the sensor, the position of the drawn-in sheet can be recognized. By means of a corresponding signal of the sensor, it is possible to actuate the coupling and thus guide the withdrawal roller into a predetermined position. A flattening on the withdrawal roller can therefore, before the drawing-in of a new sheet, always be brought into the area which is opposite the front edge of the stack of sheets in order to permit a feeding of individual sheets, as required, particularly for the feeding of a foil.

In a further development of the invention, the coupling comprises a rod which can be moved between two positions and a hub which is non-rotatably fastened on the shaft of the withdrawal roller and has a ring groove provided on one side, in which case the rod which engages in the ring groove of the hub, in each case, in an end position, interacts on one side with catches on the inner edge of the ring groove and interacts on the other side with a single catch on the outer edge of the ring groove. By means of the single catch on the outer edge, a defined position of the withdrawal roller can be adjusted by means of this coupling, while, in contrast, by means of the catches on the inner edge of the ring groove, the shaft for the withdrawal roller can be arrested and thus the paper transport can be stopped in any desired position.

In a further development of the invention, the inner edge of the ring groove of the hub has no catches within an angular area situated opposite the single catch on the outer edge of the ring groove. This measure has the purpose of preventing an unintentional stopping of the shaft when the rod is moved into that position which permits a no-contact turning past of the individual catch on the outer edge of the ring groove. This is mainly expedient when, for the drawing-in of a single sheet of paper, the withdrawal roller carries out several rotations because of its comparatively small radius. The single catch must then, in a no-contact manner, be turned past the nose of the rod so many times until the sheet of paper is completely drawn in or moved along. The latter can be recognized by the pertaining sensor. It is only then that the rod is moved into the position in which its nose can interact with the single catch. The resting of the catch against the nose will then lock the shaft and ensure the correct position of the withdrawal roller for another drawing-in of paper.

Other objects, advantages and novel features of the present invention will become apparent from the following detailed description of the invention when considered in conjunction with the accompanying drawings.

BRIEF DESCRIPTION OF THE DRAWINGS

FIG. 1A is a schematic view taken in the direction of arrow A of FIG. 1, depicting the axial length of the guiding element constructed according to certain preferred embodiments of the invention.

DETAILED DESCRIPTION OF THE DRAWINGS

Figure 1:
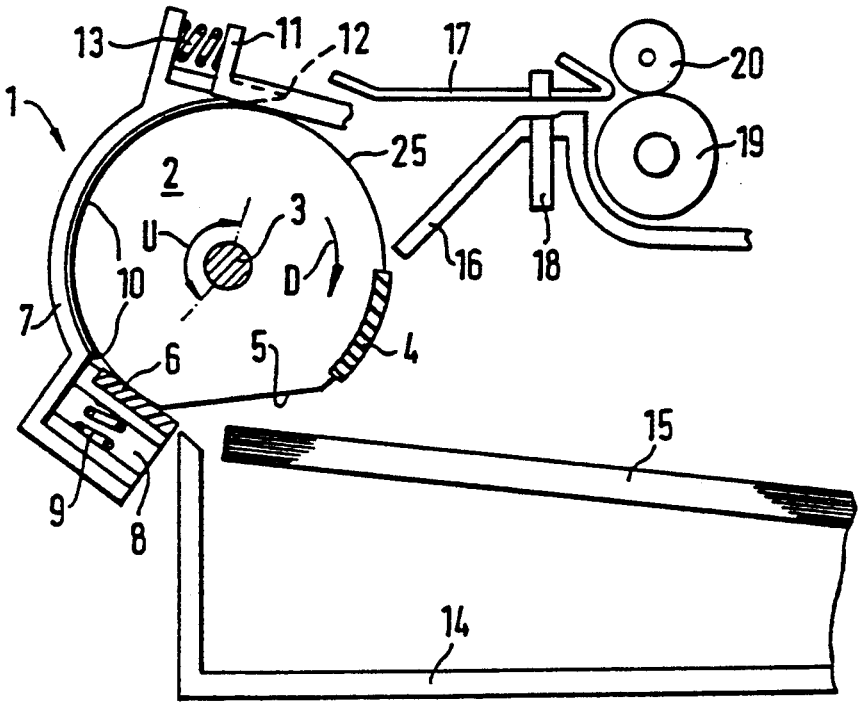
FIG. 1 is a schematic part sectional lateral view of a copying machine in the area of a deflecting device, constructed according to a preferred embodiment of the invention.

By means of a deflecting device 1 illustrated in FIG. 1, individual sheets of paper or foil are withdrawn from a stack 15 kept in a readiness position in a cassette 14 and are deflected. For this purpose, a withdrawal roller 2 is situated approximately in the center above the front side of the cassette 14 pushed into a receiving device at the copying machine, and is non-rotatably fastened on a shaft 3. The shaft 3 extends in parallel to the front-side upper edge of the cassette 14, i.e., the upper edge pointing in the withdrawal direction, and, in a manner not shown in detail, is disposed on frame parts of the copying machine.

The withdrawal roller 2 is provided with a segment-type flattening 5. Before a drawing-in of paper is to take place, the flattening 5 is disposed at a distance opposite the stack 15 and, as required, permits a contact of individual sheets that does not present any problems. For the drawing-in of the paper, the shaft 3 and the withdrawal roller 2 together are set into rotation in the direction (D) by means of a control which is not shown. A pulling rubber device 4 which is fastened to the withdrawal roller 2 and is arranged behind the flattening 5 in the shell surface 25 forming the circumference of the withdrawal roller, when moving across the stack 15, pulls off the sheet which is situated uppermost on that stack.

In addition, the withdrawal roller 2 shown here has a deflecting function. For this purpose, the shell surface 25 is surrounded within a deflecting angle area (U), at a narrow distance, by a holding device 7 which is mounted on frame parts of the copying machine and on which a leaf spring 10 is fixed. The leaf spring 10 is inserted into the gap between the holding device 7 and the shell surface 25 in such a manner that, at its ends, it is in each case held in a prestressed manner on the holding device 7 so that between its ends it rests against the shell surface 25 of the withdrawal roller 2 with a contact force. The contact pressure force is obtained as a result of the deflection of the leaf spring 10 forced by the shell surface 25 and the prestressing by means of a spring 13. At its one end 12, the leaf spring 10 is fixed to a part 11 of the holding device 7 which is tangentially slidable with respect to the withdrawal roller 2. Part 11 is supported against the force of the spring 13 with respect to the remaining part of the holding device 7, whereby the contact force of the leaf spring 10 on the shell surface 25 can be adjusted by the position of part 11 relative to the remaining part of the holding device 7. At the same time, the arrangement of the slidable part 11 facilitates the exchange of the leaf spring 10. For this purpose, it may, in addition, be provided that the holding device 7 can be swivelled away from the shell surface 25 about an axis that is not shown in the area of its lower end which is bent-away in an L-shape. As a result, possibly occurring paper jams can also be eliminated easily and simply. On the inlet side, the leaf spring 10 at first extends tangentially with respect to the withdrawal roller 2 so that an introducing gap is formed into which the forward edge of a sheet travels easily.

FIG. 1A schematically depicts preferred arrangements of the present invention wherein the axial length of the elastic guiding element has the form a strip which is narrower than the withdrawal roller and rests approximately in the center on the circumference of the withdrawal roller.

In a recess 8 formed by the lower end of the holding device 7 which, in its cross-section, is set off in an L-shape from the withdrawal roller 2, an auxiliary device is arranged for the separating of the sheets of paper. This device comprises a polyurethane rubber element 6 which by means of a spring 9 is pressed radially against the shell surface 25 of the withdrawal roller 2. Approximately by means of its center, the rubber element 6 rests against the withdrawal roller 2 with which it is aligned essentially tangentially. If the pulling rubber device 4 inadvertently withdraws several sheets, the sheets that follow the uppermost sheet are held fast by the rubber element 6 and are prevented from being drawn in further. The pulling rubber device 4 extends along a sufficiently large angular area so that it reaches the rubber element 6 before its rearward end leaves the area above the stack 15 of paper. This ensures a secure transition of the paper withdrawal movement to the paper deflecting movement which follows.

A separated sheet which is withdrawn from the stack 15 by means of the pulling rubber device 4 is guided securely during the continued transport of the paper because of the fact that the leaf spring 10 presses the sheet in the deflecting angle area (U) actively against the pulling rubber device 4 and against the remaining cylindrical area of the shell surface 25. Naturally, the angular area along which the leaf spring rests against the withdrawal roller 2 is much larger than the angular area taken up by the flattening 5 so that, in each position of the withdrawal roller 2, at least along a certain minimum section, the leaf spring 10 presses the leaf against the shell surface 25. The leaf spring 10, which is held in the circumferential direction of the withdrawal roller 2, has sufficient sliding characteristics so that the sheet to be drawn in adheres on the rotating shell surface 25 and slides past the leaf spring 10. At the end of the deflecting angle area (U) where the leaf spring 10 moves away from the shell surface 25 for the fastening with its end 12 to part 11, a drawn-in sheet leaves the area of the shell surface 25 and arrives in an area formed by two guide plates 16, 17 arranged in the manner of a funnel. From this area, the continued transport of the sheet takes place by way of transport rollers 19, 10 arranged behind it, for example, to a toner drum which follows and is not shown.

The dimensions of the withdrawal roller 2 are selected such that, for the complete drawing-in of a sheet, several rotations of the withdrawal roller 2 are required. The shape of the withdrawal roller 2, which is not rotationally symmetrical because of the flattening 5 and of the pulling rubber device 4, requires that this withdrawal roller 2 following a completed drawing-in of the sheet should again take up the defined starting position illustrated in FIG. 1. The coupling 26 shown in FIG. 2 is used for this purpose.

Figure 2:
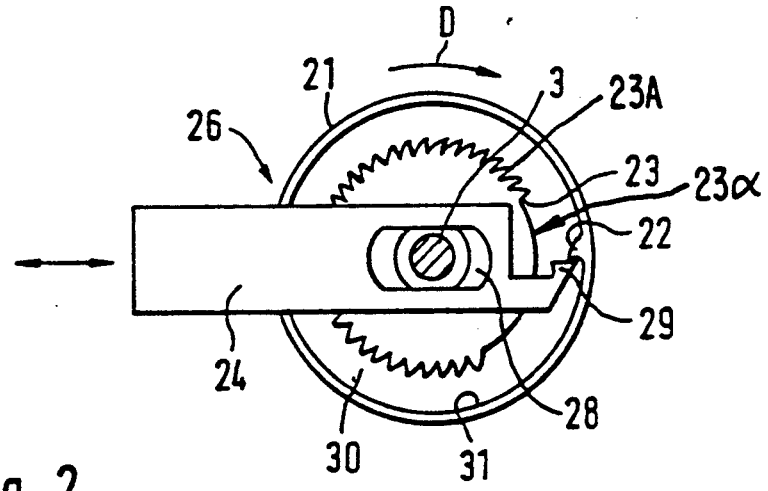
FIG. 2 is a schematic lateral view of a coupling for the shaft of a withdrawal roller of the deflecting device in FIG. 1.

The coupling 26 comprises a hub 21 which is nonrotatably disposed on the shaft 3 and the front side of which shown in FIG. 2 has a ring-shaped groove 30. A single catch in the form of a stop nose 22 is molded onto the outer circumference 31 of the ring groove 30. Sawtooth-type catches 23A are molded onto the inner circumference 23 of the ring groove 30, an angular area 23 $\alpha$ situated opposite the stop nose 22 being excluded. A nose 29, which is mounted on the end of a rod 24 that can be moved transversely between two end positions, interacts with the catches 23A on the inner circumference 23 as well as with the stop nose 22. In the area of the hub 21, the rod 24 is guided by means of an oblong hole 28 which is penetrated by the shaft 3. The coupling 26 is arranged in the area laterally above the cassette 14.

In the shown right end position of the rod 24, the nose 29 comes to a stop against the stop nose 22. Since only one stop nose 22 of this type is molded onto the outer circumference 31, this stop defines a specific position of the shaft 3 and thus of the withdrawal roller 2. In order to reach precisely this position, the rod 24 is held fast in the shown right end position and when the shaft 3 is rotated in the direction (D), and the striking of the stop nose 22 against the nose 29 is awaited. The holding-fast of the rod 24 in its right end position is caused by a paper transport control, which is not shown, when a sensor 18 shown in FIG. 1, which is arranged in front of the transport rollers 19, 20, signals that a drawn-in sheet has left this area and a new sheet may be drawn in. The sensor 18 comprises a photocell by means of which it can be recognized whether a sheet is still disposed between the guide plates 16, 17.

If, on the other hand, a running drawing-in of paper is to be stopped, the paper transport control causes a shifting of the rod 24 into its other end position which is on the left in FIG. 2. The nose 29, which is designed as a double nose, will then interact with one of the catches 23A on the inner circumference 23 of the hub 21 and stop the shaft 3 and thus the withdrawal roller 2. Such an interruption of the drawing-in movement normally takes place at the point in time at which the partially drawn-in sheet is situated with its forward edge in front of the transport rollers 19, 20 while forming a slight buckle. The sensor 18 also detects the arrival of the sheet at the transport rollers 19, 20. In this position, the sheet will be on call in order to be fed, as required, by means of the transport rollers 19, 20, to the copying machine devices which follow.

As mentioned above, the small dimensions of the withdrawal roller 2 require several rotations of this withdrawal roller 2 for the complete drawing-in of a sheet. After the drawing-in of the paper has started, the withdrawal roller 2 must therefore not be stopped by the interaction of the nose 29 with the stop nose 22 when it returns for the first time to the starting position shown in FIG. 1. For this purpose, it is provided that the paper transport control in time before a complete rotation of the withdrawal roller 2 is carried out, moves the rod 24 for a certain time period into its end position which is on the left in FIG. 2 so that the stop nose 22 does not strike against the nose 29. After it is rotated past a sufficient tolerance angle area, the rod 24 is moved back into the right end position. When the drawing-in of paper has ended and the withdrawal roller 2 is to be returned into the starting position, the rod 24 is held in the right end position so that then the stop nose 22 can strike against the nose 29, and the withdrawal roller 2 therefore arrives precisely in the starting position. The described escape movement by the temporary moving of the rod 24 into the left end position must not result in a locking of the shaft 3 by the engaging of the nose 29 in one of the catches 23A on the inner circumference 23. The inner circumference 23 is therefore not provided with catches 23A along a sufficient angular area 23 $\alpha$ which is opposite the stop nose 22. Correspondingly, a stopping of the drawing-in movement along this angular area 23 $\alpha$ is also not possible. However, since this uncertainty is limited to a relatively small paper transport path, it is harmless and only has the result that the copying paper is disposed in front of the transport rollers 19, 20 with a correspondingly larger or smaller buckle.

The advantage of the shown coupling 26 is the fact that the shaft 3 can be stopped in a defined position as well as at a desired point in time without the requirement of two different stopping mechanisms or of an additional electric monitoring. In this case, it is utilized that, by way of the paper transport control, the approximate position of the shaft 3 and thus of the withdrawal roller 2 is known. The coupling 26 will then, without any additional monitoring devices, permit the reaching of the precise starting position for the withdrawal roller 2. Preferably, the rod 24 is controlled electromagnetically and, in the currentless state of the magnet, is in the end position which interacts with the stop nose 22 and is on the right in FIG. 2. Thus, the coupling 26 requires only one stopping mechanism (magnet) and no additional monitoring device.

The invention is not limited to the shown embodiment. Numerous additional variants are contemplated, particularly with respect to the design of the guiding element.

Thus, it may be provided, for example, that the sheet to be drawn in is pressed onto the shell surface 25 in the deflecting angle area (U), instead of by means of an elastic element, by a pneumatic device by means of a pressure difference generated on the shell surface 25 of the withdrawal roller 2.

Another possibility consists of arranging rubber-type elements corresponding to the pulling rubber device 4 on the whole cylindrical part of the shell surface 25 at distances from one another in such a manner that they are disposed on the withdrawal roller 2 to be radially elastic toward the outside. The sheet is then, by means of elastic rubber elements on the shell surface 25, pressed elastically against an element which surrounds the shell surface 25 in the manner of a sleeve. Also in this case, the inserting of a strip-shaped elastic element is not necessary.

It is also contemplated to arrange an element surrounding the shell surface 25 in the manner of the holding device itself to be resting against the shell surface 25; for example, by being disposed on a shaft around which the element can be rotated, in which case the element comes to rest against the shell surface 25 as the result of this rotating movement. The contact pressure force may be applied by means of a spring pressing the element against the shell surface 25 or by the force of the weight of the element itself.

When a strip-shaped elastic element is used, this element may also consist of a teflon-coated spring element or of a teflon strip.

At any rate, in all cases an active pressing of the sheet to be drawn in against the circumference of the withdrawal roller is ensured and therefore, irrespective of the stiffness of the sheet, a reliable paper transport is guaranteed also in the case of a deflection about a comparatively small radius of curvature.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A copying machine paper deflecting device for deflecting sheets of papers being fed from a stack of sheets to the copying machine with a deflection angle of approximately 180°, said paper deflecting device comprising:

a withdrawal roller for withdrawing sheets from a stack of sheets and transporting them to a copying machine inlet, an elastic paper guiding element for pressing the sheet against the withdrawal roller during sheet withdrawal operations, and a holding device including first and second clamps, said first and second clamps being clampingly engageable with the elastic guiding element at respective spaced first and second positions and serving to hold the elastic guiding element with a predetermined contact force in partial surrounding engagement with the circumference of the withdrawal roller between said first and second positions due to elastic prestressing of the elastic guiding element between the first and second clamps, wherein the first and second clamps hold the elastic guiding element with a tensioning force such that the elastic guiding element is stretched in a circumferential guiding direction.

2. A copying machine paper deflecting device according to claim 1, wherein the elastic guiding element has the form of a strip which is narrower than the withdrawal roller and has a low coefficient of friction with respect to the sheet to be deflected and rests approximately in the center on the circumference of the withdrawal roller.

3. A copying machine paper deflecting device according to claim 2, wherein the elastic guiding element is clamped at its ends into the holding device which surrounds the circumference at a narrow distance inside a deflecting angle area.

4. A copying machine paper deflecting device according to claim 3, wherein the elastic element is one of a leaf spring, a teflon strip, and a spring element coated with teflon.

5. A copying machine paper deflecting device according to claim 3, wherein devices are provided for the adjustment of the predetermined contact force of the elastic guiding element by adjusting the spacing of the first and second clamps from one another.

6. A copying machine paper deflecting device according to claim 5, wherein the first clamp is elastically movable approximately tangentially with respect to the circumference and with respect to the remaining part of the holding device.

7. A copying machine paper deflecting device according to claim 6, wherein devices for separating the sheets of paper are integrated into the holding device.

8. A copying machine paper deflecting device according to claim 7, comprising a sensor within a paper transport area arranged behind the withdrawal roller, and a coupling which is coupled with the sensor and is arranged on a shaft of the withdrawal roller.

9. A copying machine paper deflecting device to claim 8, wherein the coupling comprises a rod which can be moved between two end positions, and a hub, which is coaxial with the non-rotatably fastened on the shaft, wherein the rod interacts in one end position by means of a nose with a majority of catches on a circumference of the hub and interacts in the other end position with an individual catch on a circumference of the hub.

10. A copying machine paper deflecting device according to claim 1, wherein the elastic guiding element is one of a leaf spring, a teflon strip, and a spring element coated with teflon.

11. A copying machine paper deflecting device according to claim 1, wherein devices are provided for the adjustment of the predetermined contact force of the elastic guiding element by adjusting the spacing of the first and second clamps from one another.

12. A copying machine paper deflecting device according to claim 1, wherein devices for separating the sheets of paper are integrated into the holding device.

13. A copying machine paper deflecting device according to claim 1, comprising a sensor within a paper transport area arranged behind the withdrawal roller, and a coupling which is coupled with the sensor and is arranged on a shaft of the withdrawal roller.

14. A copying machine paper deflecting device according to claim 13, wherein the coupling comprises a rod which can be moved between two end positions, and a hub 21, which is coaxial with and non-rotatably fastened on the shaft, wherein the rod interacts in one end position by means of a nose with a majority of catches on a first circumference of the hub and interacts in the other end position with an individual catch on a second circumference of the hub.

15. A copying machine paper deflecting device according to claim 14, wherein the first circumference forms the radial inner edge and the second circumference forms the radial outer edge of a ring groove of the hub.

16. A copying machine paper deflecting device according to claim 15, wherein no catches are provided on the first circumference in a predetermined angular area opposite the single catch.

17. A copying machine paper deflecting device for deflecting sheets of papers being fed from a stack of sheets to the copying machine with a deflection angle of approximately 180°, said paper deflecting device comprising, a withdrawal roller for withdrawing sheets from a stack of sheets and transporting them to a copying machine inlet, and a guiding element which partially surrounds the withdrawal roller and which rests against the circumference of the withdrawal roller with a predetermined contact force to thereby press the sheet against the withdrawal roller during sheet withdrawal operations, wherein the guiding element is constructed as a prestressed elastic element which is held in a holding device against the circumference of the withdrawal roller and is held in the circumferential direction, wherein devices are provided for the adjustment of the predetermined contact force of the guiding element, and wherein a part of the holding device for the elastic element is elastically movable approximately tangentially with respect to the circumference and with respect to the remaining part of the holding device.

18. A copying machine paper deflecting device for deflecting sheets of papers being fed from a stack of sheets to the copying machine with a deflection angle of approximately 180°, said paper deflecting device comprising, a withdrawal roller for withdrawing sheets from a stack of sheets and transporting them to a copying machine inlet, a guiding element which partially surrounds the withdrawal roller and which rests against the circumference of the withdrawal roller with a predetermined contact force to thereby press the sheet against the withdrawal roller during sheet withdrawal operations, a sensor within a paper transport area arranged behind the withdrawal roller, and a coupling which is coupled with the sensor and is arranged on a shaft of the withdrawal roller, wherein the coupling comprises a rod which can be moved between two end positions, and a hub, which is coaxial with a non-rotatably fastened on the shaft, and wherein the rod interacts in one end position by means of a nose with a majority of catches on a circumference of the hub and interacts in the other end position with an individual catch on a circumference of the hub.

* * * * *